United States Patent [19]

Golota

[11] 4,317,973

[45] Mar. 2, 1982

[54] DISCONNECT SWITCH AND DRIVE MECHANISM THEREFOR

[75] Inventor: John H. Golota, Pittsburgh, Pa.

[73] Assignee: Westinghouse Electric Corp., Pittsburgh, Pa.

[21] Appl. No.: 879,184

[22] Filed: Feb. 21, 1978

Related U.S. Application Data

[62] Division of Ser. No. 649,180, Jan. 15, 1976.

[51] Int. Cl.[3] ..... H01H 3/40; H01H 33/42

[52] U.S. Cl. ..... 200/153 P; 200/148 F

[58] Field of Search ..... 200/148 F, 148, 153 P

[56] References Cited

U.S. PATENT DOCUMENTS

| | | | |
|---|---|---|---|
| 2,661,401 | 12/1953 | Jocnem et al. | 200/153 P |
| 3,562,465 | 2/1971 | Turgeon | 200/153 P |
| 3,973,093 | 8/1976 | Bertrand | 200/153 P |

FOREIGN PATENT DOCUMENTS

| | | | |
|---|---|---|---|
| 1415750 | 10/1968 | Fed. Rep. of Germany | 200/148 F |
| 900430 | 10/1944 | France | 200/148 F |
| 1155192 | 11/1957 | France | 200/148 F |
| 319003 | 3/1957 | Switzerland | 200/153 P |
| 539484 | 9/1941 | United Kingdom | 200/148 F |
| 718401 | 11/1954 | United Kingdom | 200/148 F |

*Primary Examiner*—Robert S. Macon
*Attorney, Agent, or Firm*—M. S. Yatsko

[57] ABSTRACT

A disconnect switch and drive mechanism therefor particularly adapted for use in gas insulated substations. The drive mechanism comprises a pair of parallel support members having a plurality of gear teeth at one arcuate end section thereof, first and second crank members pivotally coupled to the support members and having aligned openings therein, and a connecting rod extending through the aligned openings and rotatable with respect thereto. A crank gear is rotatably coupled to the first crank element and cooperates with the gear teeth of the support member, and a rod gear is fixedly secured to the connecting rod and cooperates with the crank gear, so that upon pivotal movement of the crank elements, the support member gear teeth cause the crank gear to rotate which causes a rotation of the rod gear and the connecting rod attached thereto. A drive arm fixedly secured to the connecting rod rotates with the connecting rod. The connecting rod experiences both an arcuate and a rotational movement upon pivotal movement of the crank elements, and results in a straight line movement of the distal end of the drive arm.

2 Claims, 4 Drawing Figures

DISCONNECT SWITCH AND DRIVE MECHANISM THEREFOR

This is a division of application Ser. No. 649,180 filed Jan. 15, 1976.

BACKGROUND OF THE INVENTION

This invention relates generally to switching apparatus and more particularly to a disconnect switch and drive mechanism therefor particularly adapted for use with gas insulated power systems.

In recent years, there has come about a demand for a reduced-size substation. This demand on the part of public utilities has been met by gas insulated substation equipment. This type of substation equipment significantly reduces the space required by the high voltage value of substations rated, for example, 46 KV through 500 KV. Space reduction is accomplished by replacing the open-bus and the air-tight bushings with gas insulated bus filled, for example, with a highly insulating gas such as sulfur-hexafluoride gas at a pressure, for example of 45 pounds per square inch gauge, and thereby permitting the movement of electrical equipment very closely together.

This gas insulated substation equipment has many advantages, among which are: significant reduction in size requirements both in land area and overall height; added system reliability by eliminating the possibility of phase-to-phase fault, lightning strikes within the system, or contamination of insulators; reduced maintenance because the closed system is isolated from the environment; added personnel safety because all live parts are covered by grounded shields; and lower installation costs as compared with conventional or other types of power systems when the gas insulated modular approach is utilized.

The gas insulating system, as briefly described above, has additional design strategies, inasmuch as the high voltage equipment is compressed, so that both the space required and the total length of the bus is minimized. The power transformers may be located on outside corners so as to be capable of ready removable, and the location of cable potheads is flexible, with results that the system may be readily connected to overhead transmission lines.

It is desirable to provide a disconnect switch which will permit the isolation of certain sections of the gas insulated system. This disconnect switch must be as compact as possible, and must be capable of functioning in its installed environment. Because the switch must operate in a sealed environment, the number of elements penetrating to the outside must be minimized, to reduce the possibility of gas leakage. Since the switch must be compact, it follows that the switch drive mechanism should also be as compact as possible.

SUMMARY OF THE INVENTION

Briefly stated, the disconnect switch of this invention comprises an elongated sealed tank containing an insulating gas and having opposing ends through which electrical conductors enter the tank, and a pair of longitudinally spaced apart electrodes disposed within the tank. The electrical conductors are electrically coupled to, and terminate at, the electrodes. A reciprocating switch blade is disposed within the tank and is coupled to one of the electrodes. The blade is capable of being in two positions: one position in contact with both of the electrodes to permit the flow of electric current therebetween; and the other position is spaced apart from one of the electrodes to prohibit the flow of electric current between the electrodes. Drive means are utilized for longitudinally positioning the switch blade, with the drive means including a rotatable drive shaft extending outwardly beyond the tank, and a drive mechanism for translating the rotational movement of the drive shaft to a generally straight line movement of the switch blade. The drive mechanism is comprised of a pair of parallel, spaced apart support members having an arcuate section with a plurality of gear teeth at one end thereof. Two crank elements are pivotally coupled to the support members, with the crank elements having aligned openings therein through which extend a connecting rod. The connecting rod is rotatable with respect to the crank elements, while coupling the crank elements together. A crank gear is rotatably coupled to one of the crank elements, and is positioned adjacent to, and cooperates with, the support member gear teeth. A rod gear is fixedly secured to the connecting rod, and is positioned adjacent to, and cooperates with, the crank gear. The rod gear has a pitch diameter which is one-half the pitch diameter of the support member gear teeth. A drive arm is fixedly secured to the connecting rod and has a distal end section which is rotationally coupled to the switch blade. The distance from the connecting rod to the distal end section coupling with the switch blade is substantially the same as the distance from the connecting rod to the pivotal coupling of the crank element to the support members. A rotatable drive shaft is connected to one of the crank elements, and upon rotation of the drive shaft causes pivotal movement of the crank elements and connecting rod. The pivotal movement of the crank elements causes the support member gear teeth to rotate the crank gear, causing the rotation of the rod gear, which causes the rotation of the connecting rod within the aligned openings. The rotation and pivotal motion of the connecting rod causes a substantially straight line movement of the drive arm distal end and the switch blade connected thereto.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
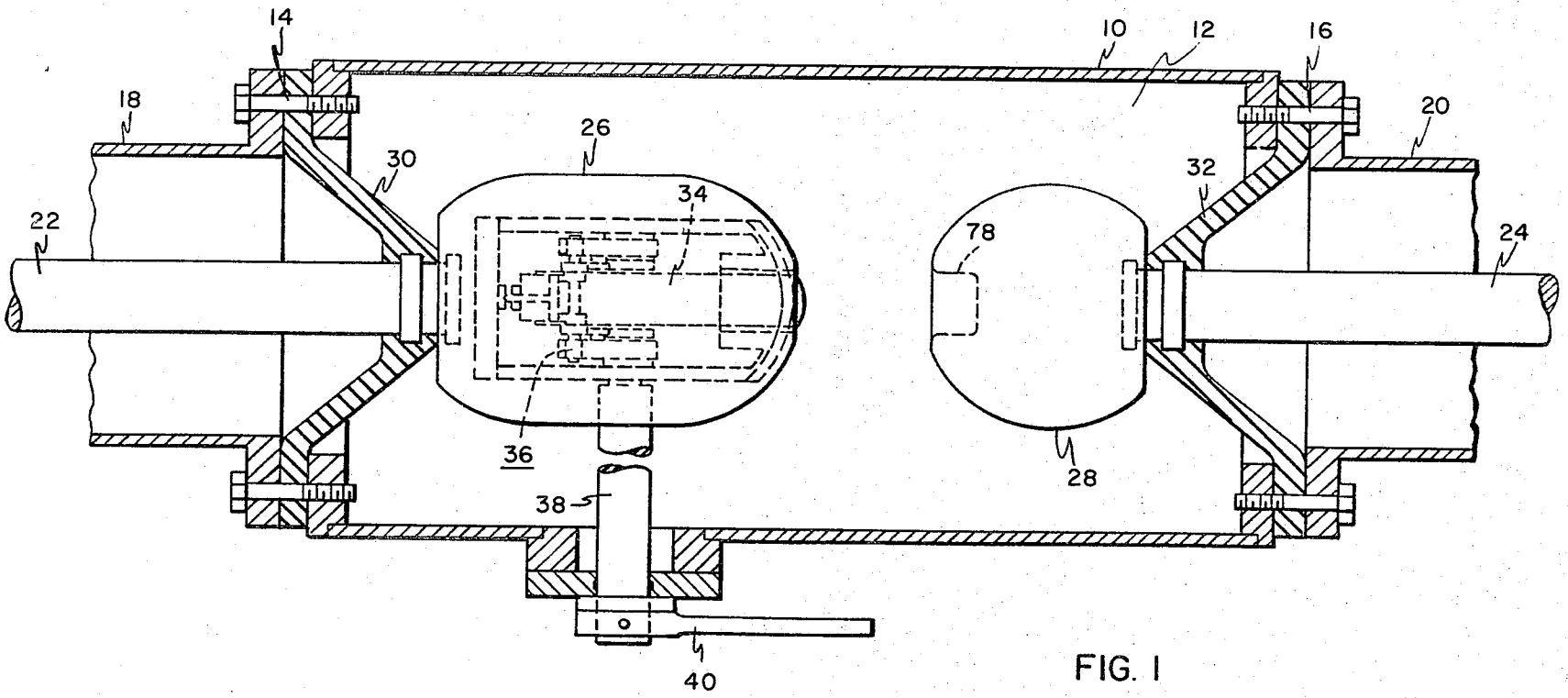
FIG. 1 is a plan view of the disconnect switch of this invention.

Referring now more particularly to FIG. 1, the disconnect switch comprises an elongated sealed tank 10 containing an electrically insulating gas 12 such as sulfurhexafluoride. The tank 10 has opposing engs 14, 16 which are connected to sections 18, 20 respectively of a compressed gas insulated transmission line. Although described as two sections 18, 20, it is to be understood that the two sections together may, for example, comprise a one-phase run of a three-phase electrical distribution system. The transmission lines 18, 20 have disposed within them electrical conductors 22, 24 which enter the sealed tank 10 of the disconnect switch through the opposing ends 14, 16, and the electric conductors 22, 24 are electrically coupled to, and terminate at, electrodes 26 and 28. The electrode 26 is disposed within the tank 10, supported by insulating spacer 30, and is electrically coupled to conductor 22. Electrode 28, disposed within the tank 10, is supported by insulating spacer 32, and is electrically coupled to electric conductor 24. The electrode 26 is longitudinally spaced apart from the electrode 28, and the electrode 26 houses a reciprocating switch blade 34. The reciprocating switch blade 34 controls the flow of electric current between the electrode 26, 28 and the electric conductors 22, 24. The switch blade 34 is capable of being in at least two positions. One of the switch blade 34 positions is in electrical contact with both of the electrodes 26, 28, to permit the flow of electric current therebetween, thereby also permitting the flow of electric current between the two conductors 22, 24. The other switch blade 34 position is in electrical contact with one electrode 26, but spaced apart from the other electrode 28, thereby prohibiting the flow of electric current between the conductors 22, 24 and electrodes 26, 28. The position of the switch blade 34 thereby determines whether the disconnect switch is open or closed.

Disposed within the electrode 26 is a drive means 36 for longitudinally positioning the switch blade 34. The drive means 34 includes a rotatable drive shaft 38 which sealingly extends beyond the tank 10. The drive means 36 translates the rotational movement of the drive shaft 38 into a substantially straight line motion. This translation is required to provide the in-line disconnect and for longitudinally moving the switch blade 34. Also disposed without the tank 10, and mechanically coupled to the drive shaft 38 are powering means 40. Although shown as a manual crank, the powering means 40 may, for example, be an electric motor.

Figure 2:
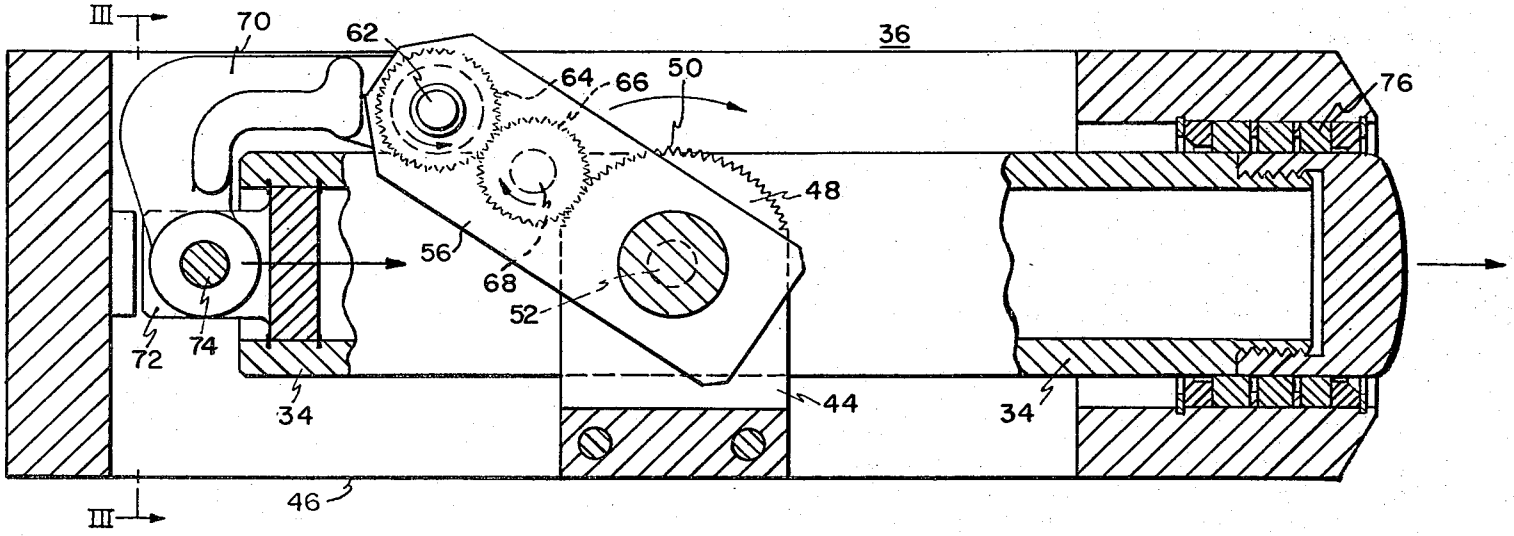
FIG. 2 is a detailed sectional view of the drive mechanism of this invention.
Figure 3:
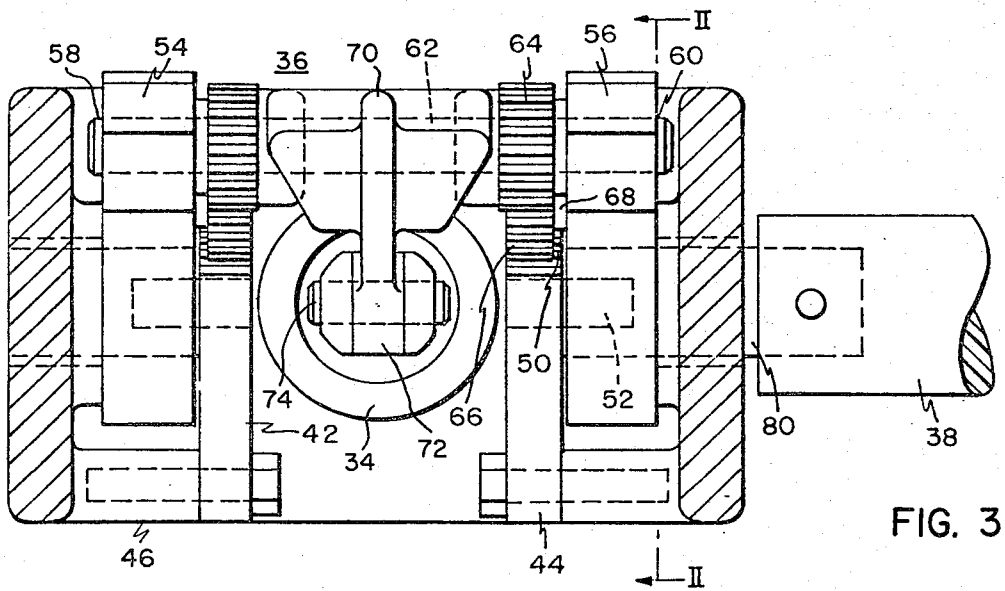
FIG. 3 is a end view of the drive mechanism illustrated in FIG. 2.

Referring now to FIGS. 2 and 3, the drive means 36 are comprised of a pair of parallel, spaced apart support members 42, 44 which are secured to a support frame 46 which in turn is secured to the electrode 26. The support member 44 has, at one end thereof, an arcuate section 48 having a plurality of gear teeth 50 therein. Pivotally coupled, by means such as pins 52, to the support member 44 are crank elements 54, 56. The crak elements 54, 56 have aligned openings 58, 60 therein and extending through the aligned openings 58, 60 is a connecting rod 62. The connecting rod 62 couples the two crank elements 54, 56 together, and the rod 62 is rotatable with respect to the crank elements 54, 56 in the aligned openings 58 and 60.

Fixedly secured to the connecting rod 62 is a rod gear 64. The rod gear 64 is positioned adjacent to, and cooperates with a crank gear 66 which is rotatably coupled to the crank element 56 by the pin 68. The crank gear 66 is positioned adjacent to, and cooperates with, the gear teeth 50 on the arcuate section 48 of the support member 44. The support member gear teeth 50 have a pitch diameter which is substantially twice the pitch diameter of the rod gear 64.

Fixedly secured to the connecting rod 62 is a drive arm 70. The drive arm 70 has a end section 72 distal from the connection of the drive arm 70 to the connecting rod 62, and the end section 72 is pivotally coupled to the switch blade 34 by the pin 74. The drive arm 70 is of a size such that the straight line distance between the pin 74 and the connecting rod 62 is substantially equal to the straight line distance from the connecting rod 62 to the pin 52 coupling the crank member 56 to the support member 44. These similar straight line distances are required to enable the drive mechanism 36 to translate the rotational movement of the drive shaft 38 to a generally straight line motion of the switch blade 34.

The switch blade 34, as previously mentioned, is connected at one end to the drive arm 70. The other end of the switch blade 34 is in electrical contact with the electrode 26 through the transfer contact 76. As shown in FIG. 2, the switch blade is spaced apart from the second electrode 28. However, to close the disconnect switch, the switch blade 34 is longitudinally moved in a straight line so that it contacts transfer contacts 78 which are part of electrode 28. This longitudinal movement occurs in a substantially straight line.

Figure 4:
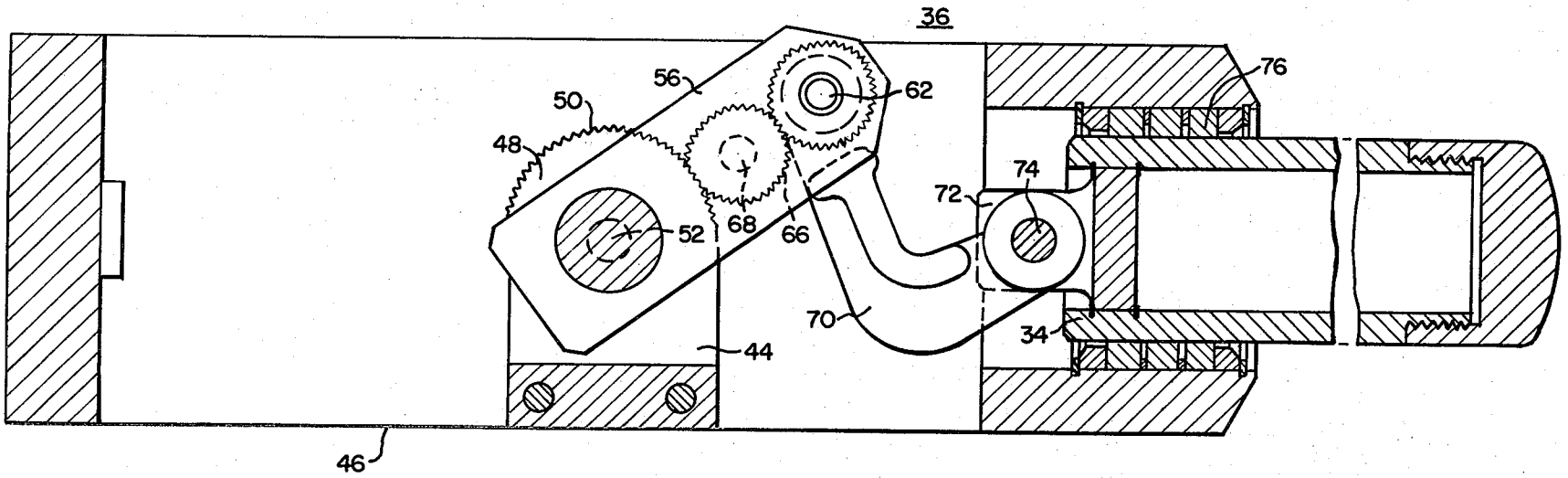
FIG. 4 is a sectional view similar to FIG. 2 showing the position of the elements moved from FIG. 2.

The operation of the drive mechanism is as follows, with reference to FIGS. 2 and 4. The powering means 40 cause a rotation of the drive shaft 38. The drive shaft 38, which is aligned with the coupling pins 52, is connected to the crank element 56 by the extension 80. The rotational movement of the drive shaft 38 causes a pivotal movement of the crank element 56 and the crank element 54 connected to it by connecting rod 62. The pivotal movement of the crank elements 54, 56 also causes a pivotal or arcuate movement of the connecting rod 62. At the same time, the pivotal movement of the crak element 56 causes the crak gear 66 to cooperate with the gear teeth 50 of the support member 44. This cooperation causes, as shown in the drawing, a clockwise rotation of the crank gear 66. The rotation of the crank gear 66 causes a counterclockwise rotation of the rod gear 64, resulting in a counterclockwise rotation of the connecting rod 62 to which the rod gear 64 is fixedly secured. Thus, during this time the connecting rod 62 is experiencing both a counterclockwise rotation within the aligned openings 58, 60 while traversing an arcuate path along with the crank elements 54, 56. The combination of the arcuate and rotational movement of the connecting rod 62 results in a substantially straight line motion of the distal end section 72 of the drive arm 70, and more particularly causes a straight line motion to occur at the pin 74. This straight line motion is transferred to the switch blade 34 which causes it to move into electrical connection with the second electrode 28.

To accomplish the opening of the disconnect switch when the switch blade 34 is in contact with both electrodes 26, 28, the reverse proces occurs, with the rotation of the drive shaft 38 and all movement being the exact reverse of that previously described. Although not shown, if it is so desired to, for example, prevent twisting of the drive mechanism 36, a similar set of gear teeth 50, rod gear 64, and crank gear 66 may be positioned on the other crank element 54. Further, if so desired, the drive arm 70 can forked so as to completely straddle the switch blade 34.

Thus, this invention provides a compact in-line disconnect switch particularly adapted for use in gas insulated systems, and which contains a drive mechanism for translating a rotational movement to a substantially straight line motion.

I claim as my invention:

1. A drive mechanism for translating rotational motion to a substantially straight line motion comprising:

a pair of parallel, spaced apart support members having an arcuate section at one end thereof, said arcuate section having a plurality of gear teeth therein;

first and second crank elements pivotally coupled to said support members, said crank elements having aligned openings therein;

a connecting rod extending through said crank element aligned openings and rotatable with respect thereto, said connecting rod coupling said crank elements together;

a crank gear rotatably coupled to said first crank element and positioned adjacent to, and cooperating with, said support member gear teeth;

a rod gear fixedly secured to said connecting rod and positioned adjacent to, and cooperating with, said crank gear, said support member gear teeth having a pitch diameter twice the pitch diameter of said rod gear;

a drive arm fixedly secured to said connecting rod and movable therewith and having an end section distal from said connecting rod, the distance from said connecting rod to said distal end section being substantially the same as the distance from said connecting rod to the location of the pivotal coupling of said crank elements to said support members;

a rotatable drive shaft coupled to one of said crank elements, rotation of said drive shaft causing pivotal motion of said crank elements and said connecting rod, the pivotal motion of said crank elements causing said support member gear teeth to rotate said crank gear, causing the rotation of said rod gear, rotation of said rod gear causing rotation of said connecting rod within said aligned opening, the rotation and pivotal motion of said connecting rod causing a substantially straight line movement of said drive arm distal end section; and means for rotating said drive shaft.

2. The drive mechanism according to claim 1 wherein said drive shaft is aligned with the pivotal coupling of said crank elements to said support members.

* * * * *